United States Patent [19]

Viveiros

[11] 4,244,584

[45] Jan. 13, 1981

[54] FLIPPABLE GAME PIECE TARGET

[76] Inventor: George Viveiros, P.O. Box 623, 237 North St., Mattapoisett, Mass. 02739

[21] Appl. No.: 72,167

[22] Filed: Sep. 4, 1979

[51] Int. Cl.[3] ..... A63B 63/00; F41J 7/00

[52] U.S. Cl. ..... 273/386; 273/58 F; 273/58 K; 273/108; 273/128 R; 273/409

[58] Field of Search ..... 273/58 F, 58 K, 108, 273/128 R, 386, 409

[56] References Cited

U.S. PATENT DOCUMENTS

| | | | |
|---|---|---|---|
| 1,494,963 | 5/1924 | Smith | 273/108 UX |
| 2,521,703 | 9/1950 | Emitt | 273/58 K |
| 3,400,932 | 9/1968 | Conrad | 273/58 F X |
| 3,610,621 | 10/1971 | Henry | 273/386 |

FOREIGN PATENT DOCUMENTS

| | | | |
|---|---|---|---|
| 367196 | 1/1923 | Fed. Rep. of Germany | 273/108 |

*Primary Examiner*—Anton O. Oechsle
*Attorney, Agent, or Firm*—Robert J. Doherty

[57] ABSTRACT

A game including a playing surface which defines a plurality of scoring areas generally in adjacent side-by-side position. A game piece which is capable of being overturned or flip-flopped between alternative flat supporting surfaces of an overall housing is provided. The game piece includes flange portions which outwardly extend from the housing and which form targets for a play ball or other element so that when such targets are forcefully struck by the playing element, the playing piece will flip-flop over on to its opposite supporting surface and thus linearly move along the playing surface so as to effect scoring by its disposition in various scoring areas thereof. The game piece housing is generally closed and supports a balancing weight preferably in the form of a relatively heavy spherical ball.

6 Claims, 5 Drawing Figures

FLIPPABLE GAME PIECE TARGET

BACKGROUND AND SUMMARY OF THE INVENTION

This invention relates to a game in which a game piece is moved about a playing surface which may include a plurality of adjacent, separately delineated scoring areas. Many games operate in such overall manner and generally differ from each other by the way in which the game piece is moved, i.e. it may be forced along the playing surface by a stick or other pushing element as in shuffle board or propelled in a linear path by another element such as in lawn bowling or marbles or even in an arcuate path as in tiddlywinks. All such games include elements of chance and skill and elementary scoring tasks in which some degree of basic addition or subtraction can be painlessly acquired by children of varying ages.

It is therefore an object of the present invention to present a game and game piece for use therewith in which such elements of skill, chance and elementary arithmetical tasks can be combined in a new and interesting game which can be played by one or more players.

It is also an object of the present invention to provide a game piece construction as above-indicated which is both entertaining when played alone or with others and which is capable of being mildly competitive and yet which includes an interesting mix of both physical and mental activity.

These and other objects of the present invention are accomplished by a game which includes a game board having a playing surface on which a flippable game piece may be moved as by being struck on one of a plurality of target flanges which outwardly extend from the housing of such game piece so as to propel the game piece along the playing surface in a desired manner. Such game piece housing defines a general enclosed interior having a movable weight disposed therein and further includes parallel and generally planar top and bottom walls on which the piece may be supported in alternate positions. The housing further includes a number of radially outwardly extending flanges parallel to and positioned vertically intermediate the top and bottom walls and connected thereto by centrally, inwardly extending sloped connecting walls which define an obtuse angular relationship with the flange portions so as to form said target areas whereby a playing element such as a ball may be thrown thereagainst so as to flip the game piece over on its opposite top or bottom surface and whereby the weight shifts by gravity so as to maintain said alternate position.

Other objects, features and advantages of the invention shall become apparent as the description thereof proceeds when considered in connection with the accompanying illustrative drawings.

DESCRIPTION OF THE DRAWINGS

In the drawings which illustrate the best mode presently comtemplated for carrying out the present invention.

DESCRIPTION OF THE INVENTION

Figure 2:
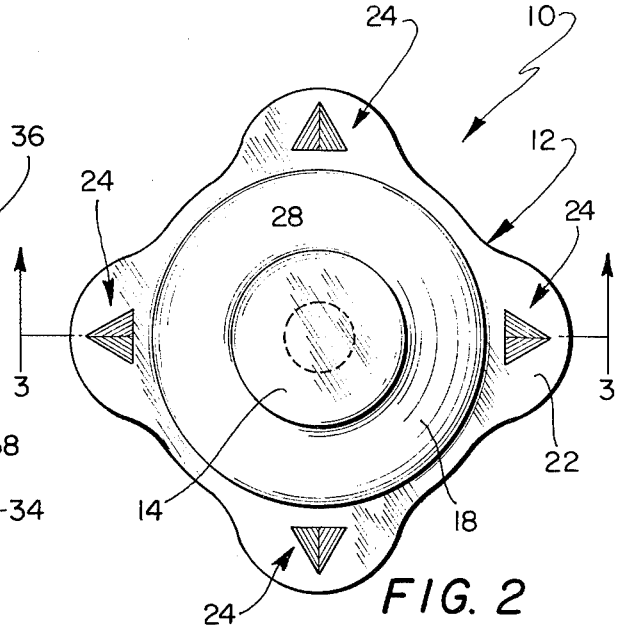
FIG. 2 is a plan view on an enlarged scale of the game piece of the present invention.
Figure 3:
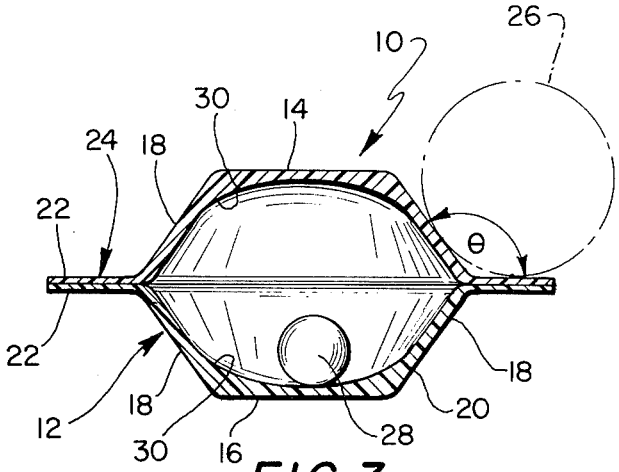
FIG. 3 is a side sectional elevational view of the game piece taken along the line 3—3 of FIG. 2.
Figure 4:
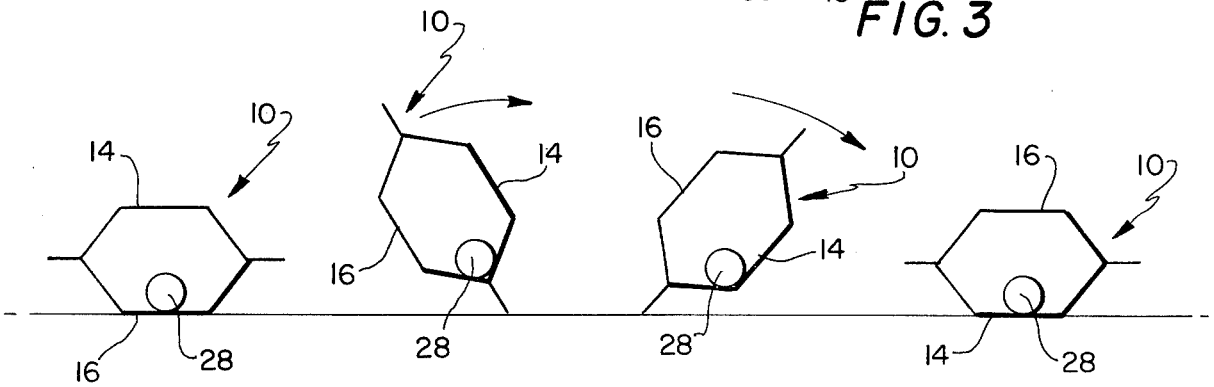
FIG. 4 is a progressive view similar to FIG. 3 but showing the manner in which the game piece is flipped on to its opposite supporting surface as by a playing element or ball as depicted in phantom in FIG. 3.

Turning now to the drawings, the structure of the game piece 10 is most evident by reference to FIGS. 2 and 3. Such game piece 10 includes a generally enclosed housing 12 in turn including a top wall 14 and a bottom wall 16 both of generally planar configuration and in spaced parallel disposition to each other. The top and bottom walls 14 and 16 are depicted as of circular configuration but may take the form of any other geometrically regular shape. They are each further provided with an upstanding outwardly flared connecting walls 18 such that the playing piece may be cooperatively formed by the attachment of the resultant generally cupped-shaped and opposed elements 20. Such attachment may be by any appropriate connection means including adhesive connection, glueing, sonic welding or mechanical attachment. Each of the cup-shaped elements 20 further includes a plurality of radially outwardly extending flanges 22 adapted for face-to-face disposition to each other and which are spaced about the periphery of the game piece 10 in a regular geometric configuration, that is, two or more such flanges 22 are provided.

Each of the flanges 22 serve to form a target area 24 for a playing element 26 such as a tennis or rubber ball. In that regard, the flanges 22 may be provided with an embossed area which may be decorated or otherwise provided with indicia so as to better designate such target area 24. Additionally, and as may best be seen in reference to FIG. 3, the connecting walls 18 are disposed radially inwardly from their adjacent flanges 22 such that an obtuse angle is defined between the outer surfaces of adjacent flange 22 and connecting wall 18 pairs. In this manner the target areas 24 will better accomodate being struck by the ball or other playing element 26. In this regard, the weight of the ball either by being dropped or thrown is such that upon striking the target area, it will downwardly force the flange 22 so as to in effect flip the game piece 10 on its opposite side, that is, if the game piece is supported on its bottom wall 16 it will flip it over so it is thereafter supported on its top wall 14.

Figure 5:
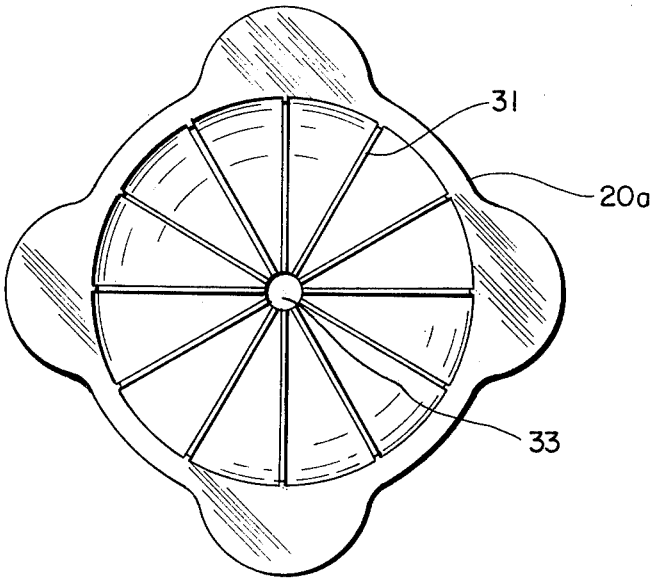
FIG. 5 is a sectional plan view of a modified construction which the game piece of the present invention may assume.

In order to better accommodate or accentuate such action, a weight 28 in the form of a rollable steel ball is disposed within the interior of the housing 12 and is free to move between alternate positions on the inner surface of either top or bottom walls 14, 16. In order to position the ball 28 centrally of each wall 14, 16, a pocket is in essence formed centrally of such surfaces by inclusion of a filleted area 30 adjacent the connection between the outer periphery of each of walls 14, 16 and its respective connecting walls 18. Such is shown as a built up or curved area which has the effect of forming a generally oval or somewhat circular trackway on the inside of the housing 12 which the ball or other weight 28 is adapted to roll between its alternate stable positions i.e., centrally above either the bottom wall 16 or the top wall 14. Also, as shown in FIG. 5, modified construction cup-shaped elements 20*a* may be provided with a plurality of upstanding ridges 31. Such ridges 31 are circumferentially spaced from each other and radiate from the center of the element which includes a small circular platform 33. Thus the platform and adjacent ridges 31 cooperatively form a runway and pocket for centering and receipt of the steel ball 28. The ridges 31 further serve to stiffen the generally preferred thin-walled construction of the element 20*a*. The elements 20 and 20*a* are formed from suitable plastic materials such as polyethylene and polypropylene or blends thereof, ABS and other lightweight, generally high impact resinous materials which can be formed to the appropriate shape by suitable molding techniques including vacuum and or pressure forming from sheet material and injection molding.

Figure 1:
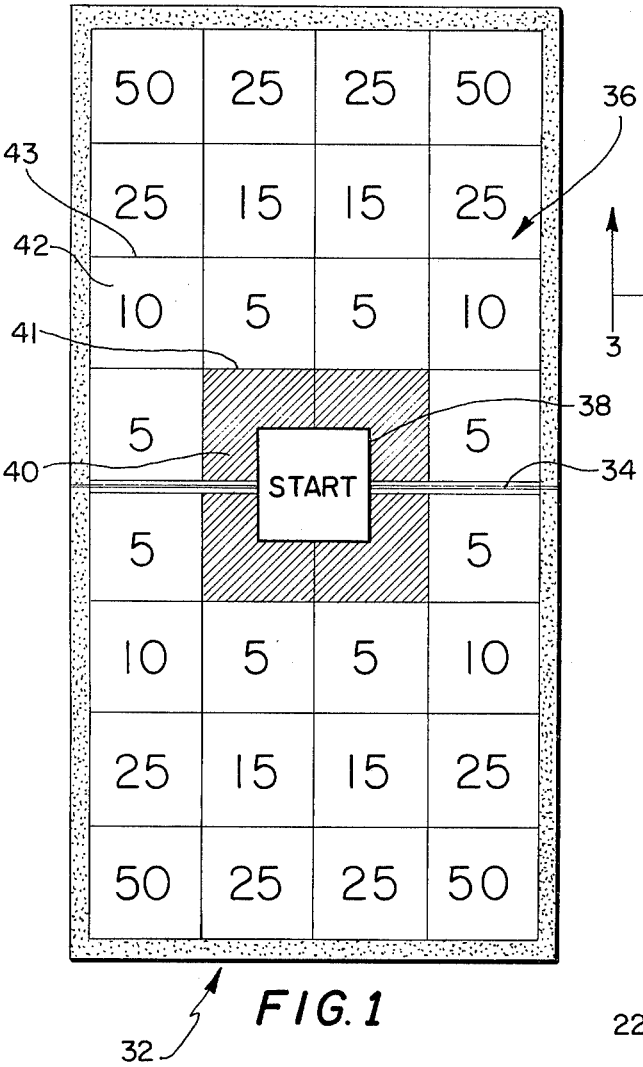
FIG. 1 is a plan view of a game board which may be utilized in the game of the present invention.

The game piece 10 of the present invention if preferably utilized in the play of the game utilizing a playing surface formed by a suitable game board 32 such as that shown in FIG. 1 of the drawing. Such game board is centrally foldable about line 34 and has an upper surface 36 provided with suitable indicia. A central area of the playing surface includes a starting square 38 which in turn is surrounded by a non-score area 40 indicated by indicia such as the lines 41 depicted. Surrounding such non-score area 40 is a plurality of scoring areas 42 suitably delineated by the lines 43 shown and marked with score values generally dependent upon the difficulty of flipping the game piece 10 in such a manner that it lands within the delineated confines of each of the scoring areas 42.

Although many playing manners may be utilized, a suitable play method includes the placing of the game piece 10 in the center of the board, that is, within the confines of the starting square 38. Thereafter, the participant or participants standing at the opposite ends of the game board 32 may throw or otherwise project the game ball or other playing element 26 at the game piece 10 aiming at one of the target areas 24 thereof. A successful toss will strike the target area 24 and tend to project the game piece towards the direction from which it was struck and flip it into an adjacent scoring area 42. When played by an individual, the game objective may be to reach a particular score or when played with opposing teams or individuals, to accumulate the highest possible score within a defined number of turns or some combination thereof. Various other rules and regulations to increase or decrease the complexity of the game so as to make it more or less competitive and to utilize more or less mental skills, such as requiring the subtraction of scores when a game piece is projected into certain areas on or off the playing surface and the like is possible. It is accordingly believed that a game piece and overall game which accomplishes the objects of the present invention in an interesting, enjoyable and possibly exciting environment is accomplished.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A flippable game piece having a housing defining a generally enclosed interior having a movable weight disposed therein, said housing including opposed parallel, generally planar, top and bottom walls on which said piece may be supported in alternate positions and on which said weight is supported, said housing of a geometrically regular configuration exhibiting a number of radially outwardly extending flange portions disposed parallel to but vertically intermediate said top and bottom walls, said flange portions connected to said top and bottom walls on either side thereof by centrally inwardly extending sloped connecting walls which define an obtuse angular relation with an adjacent flange portion, said flange portions forming targets whereby a playing element such as a ball may be thrown thereagainst so as to flip said game piece over on to its opposite top or bottom surface, whereby said weight shifts by gravity so as to maintain said alternate position.

2. The game piece of claim 1, said weight being spherical, central interior surface portions of said top and bottom walls each including a pocket for positioning said weight, and wherein adjacent interior surfaces of said top and bottom walls and said connecting walls form a trackway about which said weight may roll by gravity when struck by said playing element so as to assist in flipping said piece to an alternate position.

3. The game piece of claim 1, said target flanges extending outwardly from said connecting walls a distance of less than the height at which said flanges are disposed from either of said top and bottom walls.

4. The game piece of claim 1, said housing being of circular plan configuration, said flanges separate and circumferentially spaced from each other and being radially extending from said housing.

5. In combination with the flippable game piece of claim 1, a game board having a planar playing surface on which said game piece is adapted to rest, said playing surface including indicia defining a central disposed starting area on which said game piece is initially placed, a plurality of separate scoring areas delineated on said surface and surrounding said starting area thereof.

6. The combination game piece and game board of claim 5, wherein said playing surface includes a non-scoring zone intermediate said starting area and said scoring areas.

* * * * *